United States Patent [19]

Bergersen

[11] 4,363,947

[45] Dec. 14, 1982

[54] ELECTRICAL HEATING ELEMENT

[75] Inventor: Hans A. Bergersen, Oslo, Norway

[73] Assignee: International Standard Electric Corporation, New York, N.Y.

[21] Appl. No.: 265,294

[22] Filed: May 20, 1981

[30] Foreign Application Priority Data

Jul. 3, 1980 [NO] Norway ..... 802003

[51] Int. Cl.[3] ..... H05B 3/34

[52] U.S. Cl. ..... 219/528; 219/213; 219/345; 219/544; 219/549; 338/212

[58] Field of Search ..... 219/211, 212, 213, 345, 219/528, 529, 544, 548, 549; 29/611; 174/84; 338/210, 212

[56] References Cited

U.S. PATENT DOCUMENTS

| | | | |
|---|---|---|---|
| 2,456,468 | 12/1948 | Theodors | 219/212 |
| 2,544,547 | 3/1951 | Vogel | 219/345 X |
| 2,569,921 | 10/1951 | Cassidy et al. | 219/345 |
| 2,697,775 | 12/1954 | Licht | 219/212 |
| 2,783,358 | 2/1957 | Wolf | 219/529 |
| 2,932,711 | 4/1960 | Adams | 219/345 |
| 2,948,802 | 8/1960 | Shaw | 219/212 |
| 3,079,458 | 2/1963 | Hedstrom | 219/345 X |
| 3,299,253 | 1/1967 | Lawson, Jr. | 219/522 X |
| 3,766,644 | 10/1973 | Davis | 29/611 |

*Primary Examiner*—Volodymyr Y. Mayewsky
*Attorney, Agent, or Firm*—John T. O'Halloran; Robert E. Lee, Jr.

[57] ABSTRACT

Electrical resistance strip heating element, the insulated side areas of which are mechanically reinforced in order to render the strip less sensitive to tearing. The reinforcement may be of a slightly stretchable open mask type textile web.

2 Claims, 6 Drawing Figures

ELECTRICAL HEATING ELEMENT

BACKGROUND OF THE INVENTION

The present invention relates to a heating element comprising an electrical resistance strip which is arranged in a predetermined pattern, for example, a meander-like pattern between sheets or layers of insulation material, the width of the insulation material sheets being wider than the resistance strip arrangement.

One problem which arises in connection with installation of such heating elements is that the element may be torn at the edges or at nail holes. Under certain conditions the element can be torn so that the resistance strip pattern is disturbed or broken, which is detrimental to the heating element.

SUMMARY OF THE INVENTION

The object of the present invention is to provide a heating element wherein an electrical resistance strip arrangement is laminated to at least one insulation sheet and reinforcing material is laminated to the insulation sheet rendering its less sensitive to tearing.

BRIEF DESCRIPTION OF THE DRAWING

The above-mentioned and other features and objects of the present invention will become more apparent by reference to the following description taken in conjunction with the accompanying drawing in which.

DESCRIPTION OF THE PREFERRED EMBODIMENT

Figure 1:
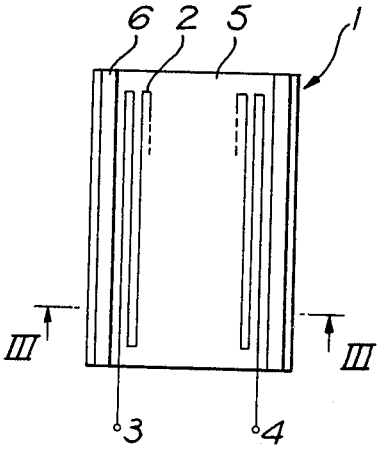
FIG. 1 illustrates a heating element according to the present invention, with one insulation sheet removed.

FIG. 1 illustrates a heating element 1 having an electrical resistance strip 2 arranged in a meander-shaped pattern, the electrical terminations being shown at 3 and 4. The resistance strip is laminated to at least one sheet of insulation material 5, the width of which is greater than that of the resistance strip arrangement. The free insulation areas outside the resistance strip arrangement are usually used for nailing or otherwise mounting the element to a wall, a ceiling or the like. In order to reinforce the insulation side areas there are, in accordance with the invention, provided sheets, tapes, fabric strips or the like of a reinforcement material 6. In a preferred embodiment the reinforcement is of the slightly stretchable textile web type so as to obtain the best possible bonding between the insulation sheet and the reinforcement. The requirement of the reinforcement is that it shall withstand at least the tearing forces of 10 Newtons for 10 seconds in any direction.

Figure 2:
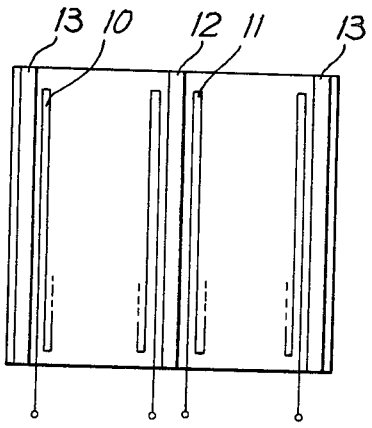
FIG. 2 illustrates a double heating element of the type shown in FIG. 1.

FIG. 2 illustrates the principle of the present invention applied to a so-called double heating element. As shown, this element consists of two resistance strip arrangements 10, 11 which may be connected in series or parallel, depending on the installation required. In this case there is also provided a reinforcement strip or the like 12 in the "side" area between the two resistance strip arrangements 10, 11, in addition to the outer reinforcements 13.

Figure 3:
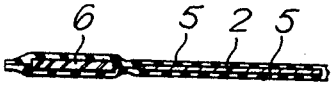
FIG. 3 illustrates a cross-section of an enlarged portion of the element shown in FIG. 1, taken at line III, and includes both insulation sheets.

FIG. 3 illustrates a cross-section of the element shown in FIG. 1, taken at line III. The resistance strip 2 is laminated between two insulation sheets 5, and the reinforcements 6 are shown also to be laminated between the insulation sheets 5. In some cases there may be used only one insulation sheet to which the resistance strip 2 and reinforcement 6 are laminated. The reinforcements 6 which are placed in the "nailing" area of the heating element, should preferably have a thickness which is greater than that of the resistance strip in order to prevent the resistance strip from being subjected to unauthorized pressure during installation. When nailing the element onto a wall or ceiling the reinforcements will take up all or most of the pressure which would otherwise have undesirable effect on the resistance strip.

Figure 4:
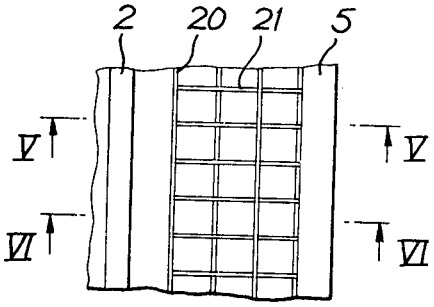
FIG. 4 illustrates an enlargement of part of a heating element having an open mask type reinforcement.

FIG. 4 schematically illustrates a side area section where the insulation sheets may be of the transparent type, and the reinforcement, which is of the slightly stretchable open mask textile web type, may be of a colored material. In this way mounting is facilitated since the mounting area will be clearly denoted.

Figure 5:
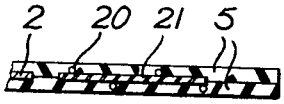
FIGS. 5 and 6 show a cross-section of the element shown in FIG. 4, taken at lines V and VI, respectively.
Figure 6:
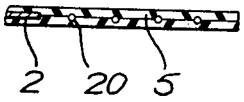

Cross-sections of the side area shown in FIG. 4 are shown in FIGS. 5 and 6 indicating that the two insulation sheets 5 meet in the spaces between the horizontal and vertical threads 20, 21 of the reinforcement, so as to obtain the best possible bonding between the insulation sheets and the reinforcement.

While I have described above the principles of my invention in connection with specific apparatus it is to be clearly understood that this description is made only by way of example and not as a limitation to the scope of my invention as set forth in the objects thereof and in the accompanying claims.

I claim:

1. Electrical resistance strip heating element comprising an electrical resistance strip, two insulation sheets between which the electrical strip is laminated, the insulation sheets having an outer periphery extending beyond the strip, and reinforcing material laminated between the insulation sheets at the outer periphery for mounting the heating element, the reinforcing material being of a slightly stretchable, open mask material through which the insulation sheets come into contact, the reinforcing material having a thickness greater than the electrical resistance strip.

2. The heating element according to claim 1 wherein said insulation sheets is transparent and said reinforcing material has a color.

* * * * *